US006786086B2

(12) United States Patent
Hashem

(10) Patent No.: US 6,786,086 B2
(45) Date of Patent: Sep. 7, 2004

(54) DETERMINING THE IN SITU EFFECTIVE MOBILITY AND THE EFFECTIVE PERMEABILTY OF A FORMATION

(75) Inventor: Mohamed Naguib Hashem, New Orleans, LA (US)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 10/344,628

(22) PCT Filed: Jan. 17, 2002

(86) PCT No.: PCT/EP02/00518

§ 371 (c)(1),
(2), (4) Date: Feb. 14, 2003

(87) PCT Pub. No.: WO02/070864

PCT Pub. Date: Sep. 12, 2002

(65) Prior Publication Data

US 2004/0093937 A1 May 20, 2004

Related U.S. Application Data

(60) Provisional application No. 60/302,982, filed on Jul. 3, 2001.

(30) Foreign Application Priority Data

Jan. 18, 2001 (EP) ..... 01200177

(51) Int. Cl.[7] ..... E21B 49/08

(52) U.S. Cl. ..... 73/152.41; 73/152.41; 73/152.24; 73/152.26; 73/152.55; 73/599; 73/863.85; 73/864.73; 166/252; 702/12

(58) Field of Search ..... 73/152.41, 152.24, 73/152.26, 152.55, 863.85, 864.73, 599; 166/252.5; 702/12

(56) References Cited

U.S. PATENT DOCUMENTS

| | | | | | |
|---|---|---|---|---|---|
| 4,823,875 | A | * | 4/1989 | Hill | 166/280.1 |
| 5,644,076 | A | | 7/1997 | Proett et al. | |
| 6,095,245 | A | * | 8/2000 | Mount | 166/276 |
| 6,388,251 | B1 | * | 5/2002 | Papanyan | 250/269.1 |
| 6,401,538 | B1 | * | 6/2002 | Han et al. | 73/599 |

FOREIGN PATENT DOCUMENTS

| | | |
|---|---|---|
| WO | 96/12088 | 4/1996 |
| WO | 97/08424 | 3/1997 |

OTHER PUBLICATIONS

"Wireline Formation Testing and Sampling" 1996, Schlumberger, Interpretation Review, pp. 6–1 to 6–8.

* cited by examiner

*Primary Examiner*—Hezron Williams
*Assistant Examiner*—André K. Jackson

(57) ABSTRACT

A method for determining the in-situ effective mobility of hydrocarbons in a formation layer, in which a formation test tool, having a fluid analyzer, induces sample fluid to flow from the formation, the sample being analyzed and discarded where it includes fluid from the invaded zone, so as to perform the pressure test on uncontaminated formation fluid.

12 Claims, No Drawings

DETERMINING THE IN SITU EFFECTIVE MOBILITY AND THE EFFECTIVE PERMEABILTY OF A FORMATION

This application claims the benefit of Provisional Application No. 60/302,982, filed Jul. 3, 2001.

PRIORITY CLAIM

The present application claims priority on European Patent Application 01200177.2, filed on Jan. 18, 2001.

FIELD OF THE INVENTION

The present invention relates to determining the in situ effective mobility ($\lambda$) of a formation layer. The effective mobility of a formation is defined as $\lambda=k/\mu$, wherein k is the formation permeability (unit Darcy, dimension $L^2$) and wherein $\mu$ is the dynamic viscosity (unit Poise, dimension $ML^{-1}T^{-1}$). The unit of mobility $\lambda$ is Darcy/Poise and its dimension is $M^{-1}L^3T$. The formation layer is a hydrocarbon-bearing formation layer. In the specification and in the claims, the term 'effective mobility' is used to refer to the mobility of the formation with respect to the uncontaminated formation fluid, and the term 'mobility' is used to refer to the mobility of the formation with respect to contaminated formation fluid.

BACKGROUND OF THE INVENTION

A method of determining the mobility is described in the book Wireline Formation Testing and Sampling, Schlumberger, 1996 on pages 6-3 to 6-8. The known method comprises the steps of:

a) selecting a location in the formation layer;

b) lowering in the borehole to the location a tool that comprises a central conduit having an inlet and being provided with a pressure sensor, a fluid receptacle having an inlet opening into the central conduit, and means for discharging fluid from the central conduit;

c) making an exclusive fluid communication between the formation and the inlet of the central conduit by extending into the formation a probe having an outlet that is in direct fluid communication with the inlet of the central conduit;

d) allowing formation fluid to enter into the fluid receptacle and measuring the pressure build-up; and e) determining the effective mobility from the pressure build-up.

The mobility is determined in two stages. At first the pressure build-up curve is compared with curves determined for different regimes of fluid flow through the formation into the probe. This comparison allows selecting an actual flow regime. Then the mobility is calculated from the measured data and the selected actual flow regime.

It will be understood that when the dynamic viscosity is known, the formation permeability can be calculated from the mobility.

This is called a pre-test build-up analysis. A disadvantage of the pre-test build-up analysis is that one determines the mobility of the formation with respect to the drilling mud that invaded the formation during drilling. Because the formation fluid is contaminated, its viscosity will not be the same as the viscosity of the uncontaminated formation fluid, and thus this pretest mobility will not be the same as the mobility of the formation with respect to the formation hydrocarbons.

SUMMARY OF THE INVENTION

However, Applicant had found that the pre-test build-up analysis can be used to determine an average value of the true or effective formation permeability.

To this end, the method of determining the average in situ permeability of a formation layer traversed by a borehole according to the present invention comprises the steps of a) selecting a set of locations in the formation layer;

b) selecting from the set a first location;

c) lowering in the borehole to the location a tool that comprises a central conduit having an inlet and being provided with a pressure sensor, a fluid receptacle having an inlet opening into the central conduit, a fluid analyser, and means for discharging fluid;

d) making an exclusive fluid communication between the formation and the inlet of the central conduit;

e) allowing formation fluid to pass through the central conduit, allowing the formation fluid to enter into the fluid receptacle, and measuring the pressure build-up;

f) determining the mobility from the pressure build-up;

g) positioning the tool near a next location and repeating steps d) through f) until the mobilities of the locations in the set have been determined;

h) determining for one location of the set the effective mobility, calculating the permeability for this location using the known viscosity of the uncontaminated formation fluid, and determining the viscosity of contaminated formation fluid using the permeability and the mobility determined in step f) for that location; and k) calculating the permeabilities for the other locations of the set using the viscosity of the contaminated formation fluid and the mobility determined in step f), and calculating the average of the permeabilities, wherein determining the effective mobility, which is the mobility of the formation with respect to the uncontaminated formation fluid, comprises the steps of 1) selecting a location in the formation layer;

2) lowering in the borehole to the location a tool that comprises a central conduit having an inlet and being provided with a pressure sensor, a fluid receptacle having an inlet opening into the central conduit, a fluid analyser, and means for discharging fluid;

3) making an exclusive fluid communication between the formation and the inlet of the central conduit;

4) allowing formation fluid to pass through the central conduit, analysing the fluid, allowing the formation fluid to enter into the fluid receptacle when the fluid is the substantially uncontaminated formation fluid, and measuring the pressure build-up; and 5) determining the effective mobility from the pressure build-up.

It will be understood that it takes some time before the drilling mud is displaced and uncontaminated formation fluid enters into the central conduit. However, this is not such a large drawback, because, in general, a sample of the uncontaminated formation fluid is also needed, so that the pressure build-up test according to the invention can be carried out after a sample has been taken.

DETAILED DESCRIPTION OF THE PREFERRED EMBODIMENT

The present invention will now be described in more detail.

The first step of the method of determining the in situ effective mobility of a formation layer traversed by a borehole comprises selecting a location in the formation layer where the effective mobility is to be determined. Then a tool is lowered in the borehole to that location. The tool comprises a central conduit having an inlet and being provided with a pressure sensor, a fluid receptacle having an inlet opening into the central conduit, a fluid analyser, and means for discharging fluid.

Once the tool has arrived at the location, an exclusive fluid communication is made between the formation and the inlet of the central conduit. By making an exclusive fluid communication, fluids present in the borehole cannot enter into the central conduit of the tool. Formation fluid is allowed to pass through the central conduit, and initially this formation fluid is discharged from the central conduit. Since this formation fluid is contaminated with invaded drilling mud it is not the uncontaminated formation fluid.

Before discharging, the formation fluid that is allowed to pass through the central conduit is analysed. And only if the analysis shows that the formation fluid is not contaminated a pressure build-up test is carried out. To this end, the formation fluid is allowed to enter into the fluid receptacle when the fluid is the substantially uncontaminated formation fluid, and the pressure build-up is measured.

Then the effective mobility is determined from the pressure build-up in the same way as described above. With the method according to the present invention the effective mobility, which is the mobility with respect to the uncontaminated formation fluid, is accurately determined.

Although the pre-test build-up analysis is not suitable for determining the effective mobility, Applicant had found that it can suitably be used to determine the most suitable location for taking a sample of the formation fluid.

To this end the first step of the method according to the present invention, selecting a location in the borehole comprises carrying out the pre-test build-up at several locations in the borehole and selecting the location having the largest mobility.

Thus at first a first location in the borehole is selected.

Then an exclusive fluid communication is made between the formation and the inlet of the central conduit, formation fluid is allowed to enter into the fluid receptacle and the pressure build-up is measured. The mobility at that location is then determined from the pressure build-up. Thereafter a next location is selected and the pre-test build-up analysis is repeated until the mobilities of a predetermined number of locations have been determined.

The location having the largest mobility as the location to be used for taking a sample, because at that location taking a sample goes fastest. The sample is suitably taken before the pressure build-up test is carried out and it is stored in a sample container in the tool.

It will be understood that the fluid receptacle is emptied after each determination of the pressure build-up.

Applicant had also found that the pre-test build-up analysis can suitably be used to determine an average value of the true or effective formation permeability. The method that is below described is suitably applied to a borehole drilled with oil-based mud.

At first a set of locations in the formation layer is selected, then the first of the set is selected. A tool is lowered in the borehole to the first location. The tool comprises a central conduit having an inlet and being provided with a pressure sensor, a fluid receptacle having an inlet opening into the central conduit, a fluid analyser, and means for discharging fluid. An exclusive fluid communication is made between the formation and the inlet of the central conduit. Formation fluid is allowed to pass through the central conduit, it is allowed to enter into the fluid receptacle, and the pressure build-up is measured. From this pressure build-up the mobility ($\lambda^i$) is determined.

The tool then is positioned near a next location where the mobility is determined, and so on until the mobilities ($\lambda^i$) of the locations i in the set have been determined.

Then for one location of the set the effective mobility ($\lambda^1_{eff}$) is determined, as described above. With the known dynamic viscosity ($\mu$) of the uncontaminated formation fluid the permeability ($k^1=\lambda^1_{eff}\cdot\mu$) for this location can be determined. Thus for this one location both the mobility ($\lambda$) and the effective mobility ($\lambda_{eff}$) have been determined. With the permeability and the mobility, the dynamic viscosity ($\mu_{cont}$) of contaminated formation fluid is calculated ($\mu_{cont}=k^1/\lambda^1$) for location 1.

Now the permeabilities ($k^i$) for the other locations of the set are calculated using the dynamic viscosity ($\mu_{cont}$) of the contaminated formation fluid and the mobilities ($\lambda^i$), with the equation $k^i=\lambda^i\cdot\mu^{cont}$. The average permeability is the average from the values $k^i$.

Here use is made of the dynamic viscosity ($\mu$) of the uncontaminated formation fluid, which is assumed to be known. This dynamic viscosity can be determined at surface from the sample that is taken.

Alternatively the dynamic viscosity can be determined from the pressure gradient. This method involves calculating along the formation layer the pressure gradient, and determining the dynamic viscosity from the pressure gradient using an empirical relation that had been obtained by fitting a curve through previously obtained data points comprising the measured dynamic viscosity as a function of the pressure gradient.

Alternatively, the dynamic viscosity of the hydrocarbon reservoir fluid can be obtained using an optical fluid analyser in the tool. The method of determining the viscosity then comprises selecting a location in the formation layer; lowering in the borehole to the location a tool that comprises a central conduit having an inlet, means for displacing fluids through the central conduit, and an optical fluid analyser; making an exclusive fluid communication between the formation and the inlet of the central conduit; obtaining a spectrum of the optical density; calculating a first factor that is the maximum optical density in a predetermined short-wavelength range multiplied with the length of the short-wavelength range, calculating a second factor which is the integral over the same short-wavelength range of the spectrum, subtracting the second factor from the first factor and dividing this difference by the optical density of the oil peak to obtain an oil factor; and obtaining the magnitude of the in situ viscosity from the oil factor using a relation that had been obtained by fitting a curve through previously obtained data points comprising the measured magnitude of the actual viscosity as a function of oil factor.

So far the method according to the present invention has been discussed with reference to an open hole, that is an uncased borehole.

The method of determining the in situ effective mobility according to the invention can as well be applied in a cased borehole, which is a borehole lined with a casing to prevent it from collapsing. The casing is cemented in the borehole, and a layer of set cement fills the annulus between the inner surface of the borehole and the outer surface of the casing.

In a cased borehole the casing has to be perforated before an exclusive fluid communication can be made. Therefore is this case the steps of lowering the tool into the cased borehole and making an exclusive fluid communication comprise at first making a perforation set through the casing wall into the formation at the location. The perforation set is made using a perforating gun. This is an elongated body provided with a plurality of outwardly directed charges. The charges are arranged at different locations along the body oriented in different directions, and they can be activated electrically or mechanically. The charges are so designed that each charge on activation produces a perforation including a perforation tunnel that extends through the wall of the casing into the formation surrounding the borehole. The perforating gun can be lowered into the cased borehole by means of for example a wireline.

Then the tool is lowered into the cased borehole to the perforation set. The tool is further provided with an upper and a lower packer arranged at either side of the inlet of the central conduit, wherein the central conduit opens below the lower packer, and wherein the distance between the upper and the lower packer is larger than the height of a perforation set. Then, the step of making an exclusive fluid communication is completed by setting the packers so that the perforation set is straddled between the packers. The packers are set to seal off a sampling space between the packers into which all the perforations open.

The pre-test build-up analysis can also be applied in a cased borehole in order to select the location in the borehole where a sample is taken. Then selecting this location starts with making a plurality of perforation sets through the casing wall into the formation layer. Then the tool is lowered to the first perforation set. The tool is further provided with an upper and a lower packer arranged at either side of the inlet of the central conduit, wherein the discharge opens below the lower packer, wherein the distance between the upper and the lower packer is larger than the height of a perforation set, and wherein the spacing between adjacent perforation sets is at least equal to the length of the longest packer. The packers are set so that the perforation set is straddled between the packers. Formation fluid is allowed to enter into the fluid receptacle, the pressure build-up is measured, and the mobility is determined from the pressure build-up.

Then the tool is positioned near the next perforation set and the mobility is determined, these steps are repeated until the mobilities of a predetermined number of locations have been determined. Then the location having the largest mobility is selected as the location where a sample is taken.

The method of determining the average in situ permeability of a formation layer can also be applied in a cased borehole. In this case a plurality of perforation sets is made through the casing wall into the formation layer. A first perforation set is selected and the tool provided with packers is lowered in the cased borehole to the first perforation set. The packers are set so that the perforation set is straddled between the packers. Formation fluid is allowed to pass through the central conduit, it is allowed to enter into the fluid receptacle, and the pressure build-up is measured. The mobility is determined from the pressure build-up. Then the tool near the next perforation set, and the mobilities of a predetermined number of locations are determined.

The next steps are similar to the steps described above to determine the average permeability.

In case the hydrocarbon reservoir fluid is a so-called heavy oil that is relatively viscous, it will be difficult to acquire a representative sample of the reservoir fluid. In order to obtain a representative sample, the step of making an exclusive fluid communication further includes activating a heating device arranged near the probe to heat the formation fluid.

Suitably, the probe is associated with a packer pad in an assembly, and the heating device is placed in the packer pad. Alternatively the heating device is arranged on the tool. The heating device may be a device generating microwaves, light waves or infrared waves. The heating device may also be an electrical heater, a chemical heater or a nuclear heater.

What is claimed is:

1. A method for determining the average in situ permeability of a formation layer traversed by a borehole, the steps comprising:

a) selecting a set of locations in the formation layer;

b) selecting from the set a first location;

c) lowering a formation test tool in the borehole to the location, the tool comprising a central conduit having an inlet and being provided with a pressure sensor, a fluid receptacle in fluid communication with the central conduit, a optical fluid analyzer, a fluid sample chamber in fluid communication with the central conduit, and means for discharging fluid;

d) establishing an exclusive fluid communication between the formation layer and the inlet of the central conduit;

e) inducing formation fluid to flow from the formation layer through the central conduit, entering the fluid receptacle, and measuring formation fluid pressure build-up;

f) determining formation permeability and formation fluid mobility from the pressure build-up;

g) positioning the tool near a next location in the set and repeating steps d) through f), determining the formation fluid mobility at of the locations in the set;

h) determining the location in the set having the highest mobility, the effective mobility, calculating the permeability for this location based on viscosity of the uncontaminated formation fluid and effective mobility, and determining viscosity of contaminated formation fluid using the permeability and the effective mobility for that location; and i) recalculating the permeabilities for the other locations in the set using the viscosity of the contaminated formation fluid and the mobility measured in step f), for that location and calculating the average of the permeabilities.

2. The method of claim 1, wherein viscosity of the uncontaminated formation fluid is determined by surface analysis of formation fluid stored in said tool fluid sample chamber.

3. The method of claim 1, wherein viscosity of the uncontaminated formation fluid is determined by the tool optical fluid analyzer.

4. The method of claim 1, wherein viscosity of the uncontaminated is empirically determined utilizing the measured formation fluid pressure build-up and an existing data set correlating viscosity as a function of formation fluid pressure build-up.

5. The method of claim 1, wherein making an exclusive fluid communication between the formation and the inlet of the central conduit comprises extending into the formation a probe having an outlet that is in fluid communication with the inlet of the central conduit of the tool.

6. The method of 5, wherein making an exclusive fluid communication further includes activating a heating device arranged near the probe to heat the formation fluid.

7. A method for determining the average in situ permeability of a formation layer traversed by a cased borehole, the steps comprising:

a) creating a plurality of perforation sets in cased borehole, to place the cased borehole in fluid communication with the formation layer;

b) selecting a set of locations in the formation layer;

c) selecting from the set a first location;

d) lowering a formation test tool in the borehole to the location, the tool comprising a central conduit having an inlet and being provided with a pressure sensor, a fluid receptacle in fluid communication with the central conduit, a optical fluid analyzer, a fluid sample chamber in fluid communication with the central conduit, and means for discharging fluid, the tool further having an upper and a lower inflatable packer, disposed above and below the fluid inlet, the upper and lower packers, when inflated, isolating the selected set of perforations from the remaining perforation sets;

e) inflating the upper and lower packers;

f) establishing an exclusive fluid communication between the formation layer and the inlet of the central conduit;

g) inducing formation fluid to flow from the formation layer through the central conduit, entering the fluid receptacle, and measuring formation fluid pressure build-up;

h) determining formation permeability and formation fluid mobility from the pressure build-up;

i) deflating the upper and lower packers and positioning the tool near a next perforation set and repeating steps e) through h), determining the formation fluid mobility for the perforation sets;

j) determining the perforation set having the highest mobility, the effective mobility, calculating the permeability for this perforation set based on viscosity of uncontaminated formation fluid, and determining viscosity for contaminated formation fluid using the permeability and the effective mobility for that perforation set; and k) recalculating the permeabilities for the other perforation sets using the viscosity of contaminated formation fluid and the mobility measured in step h), for that location and calculating the average of the permeabilities for all perforation sets.

8. The method of claim 7, wherein viscosity of the uncontaminated formation fluid is determined from formation fluid stored in said tool fluid sample chamber.

9. The method of claim 7, wherein viscosity of the uncontaminated formation fluid is determined by the tool optical fluid analyzer.

10. The method of claim 7, wherein viscosity of the uncontaminated is empirically determined utilizing the measured formation fluid pressure build-up and an existing data set correlating viscosity as a function of formation fluid pressure build-up.

11. The method of claim 7, wherein making an exclusive fluid communication between the formation and the inlet of the central conduit comprises extending into the formation a probe having an outlet that is in fluid communication with the inlet of the central conduit of the tool.

12. The method of 11, wherein making an exclusive fluid communication further includes activating a heating device arranged near the probe to heat the formation fluid.

* * * * *